United States Patent [19]

Sampson et al.

[11] 4,408,886

[45] Oct. 11, 1983

[54] MIXING EQUIPMENT

[75] Inventors: John D. Sampson; David J. W. Sparrow, both of Burton-on-Trent, England

[73] Assignee: Coal Industry (Patents) Limited, London, England

[21] Appl. No.: 349,491

[22] Filed: Feb. 17, 1982

Related U.S. Application Data

[63] Continuation of Ser. No. 116,526, Jan. 29, 1980, abandoned.

[30] Foreign Application Priority Data

Feb. 2, 1979 [GB] United Kingdom ..... 7903693

[51] Int. Cl.[3] ..... B01F 15/02; B28C 5/06

[52] U.S. Cl. ..... 366/13; 222/56; 366/28; 366/40; 366/51; 366/65; 406/90; 406/129

[58] Field of Search ..... 366/10–13, 366/16–20, 28, 33–35, 40, 101, 106, 151–153, 161, 163, 167, 177, 179, 606, 51, 65; 222/56, 64–66; 406/23, 33, 77, 82, 89, 90, 129

[56] References Cited

U.S. PATENT DOCUMENTS

| | | | |
|---|---|---|---|
| 3,198,386 | 8/1965 | Hartley | 222/56 |
| 3,554,609 | 1/1971 | Rollins | 406/129 |
| 3,580,643 | 5/1971 | Spitzer | 406/90 |
| 3,705,710 | 12/1972 | Mueller | 366/11 |
| 3,769,874 | 11/1973 | Williams et al. | 406/23 |
| 4,019,641 | 4/1977 | Merz | 406/89 |

*Primary Examiner*—Philip R. Coe
*Assistant Examiner*—Timothy F. Simone
*Attorney, Agent, or Firm*—James Creighton Wray

[57] ABSTRACT

Powdered or particulate material, especially cement which is prone to caking, is stored in a fluidized storage container (1) and is conveyed in predetermined amount by conveyor means (15) to a mixer unit (20). The material is mixed with water which is also supplied to the mixer unit to form a grout which can be used in pump packing systems in underground mines. The invention provides simple equipment capable of reliably handling large quantities of cement, and is particularly suited for use underground in coal mines. (References to FIG. 1).

9 Claims, 3 Drawing Figures

MIXING EQUIPMENT

This application is a continuation of application Ser. No. 116,526, filed Jan. 29, 1980, abandoned.

This invention relates to equipment for mixing powdered or particulate material with a liquid.

In particular, although not exclusively, the present invention relates to equipment for mixing powdered or particulate material, for example, cement, with water to form a grout.

An object of the present invention is to provide equipment for mixing cement with water to form a grout which can handle relatively large quantities of cement rapidly and which is reliable and simple to operate.

According to the present invention, equipment for mixing powdered or particulate material with a liquid comprises a fluidised storage container for the powdered or particulate material, a blower unit for blowing fluidising air into the container, a mixer unit for mixing powdered or particulate material with the liquid, conveyor means for feeding powdered or particulate material to the mixer unit, liquid feed means for feeding liquid to the mixer unit, and outlet means from the mixer unit for delivering a mixture of powdered or particulate material and liquid.

Conveniently, the conveyor means feeds the powdered or particulate material directly from the fluidised storage container to the mixer unit.

Alternatively, the conveyor means feed the powdered or particulate material from a receiver unit to the mixer unit, the receiver unit being supplied with powdered or particulate material from the fluidised storage container.

Preferably, the receiver unit is provided with a sensor arranged to sense when the level of powdered or particulate material in the receiver unit falls below a pre-selected level.

Preferably, the receiver unit is provided with a sensor arranged to sense when the level of powdered or particulate material in the receiver rises above a pre-selected level.

Advantageously, each sensor is arranged to derive an indication signal upon the level of powdered or particulate material passing the associated pre-selected level.

Advantageously, metering means are provided to meter the amount of material fed to the mixer unit to control the constituency of the mixture.

Advantageously, the mixer unit comprises a mechanically driven paddle.

Conveniently, the blower unit is arranged to extract spent fluidising air from the container and in which the fluidised storage container may be sealed from the atmosphere.

Alternatively, at least some of the spent fluidising air at least partially activates a pneumatic conveying arrangement to convey powdered or particulate material from the fluidised storage container to the receiver unit.

Advantageously, an extractor unit is arranged to extract air from the receiver unit.

Preferably, the receiver unit is sealed from the atmosphere.

Advantageously, the conveyor means includes a relatively lowermost compartment for receiving powdered or particulate material, a relatively uppermost compartment for feeding material to the mixer unit, and an elevating conveyor for conveying material from the lowermost compartment to the uppermost compartment.

Preferably, the mixer unit comprises a pump for urging the mixture along pipe means.

Preferably, the fluidised storage container is mobile.

By way of example only, two embodiments of the present invention will be described with reference to the accompanying drawings, in which.

Figure 1:
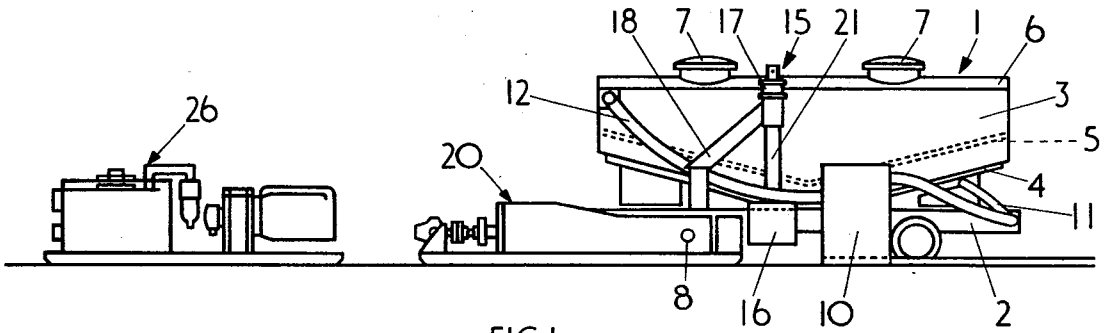
FIG. 1 is a diagrammatic layout of equipment for mixing cement and water to form a grout, the equipment being constructed in accordance with one embodiment of the present invention.
Figure 2:
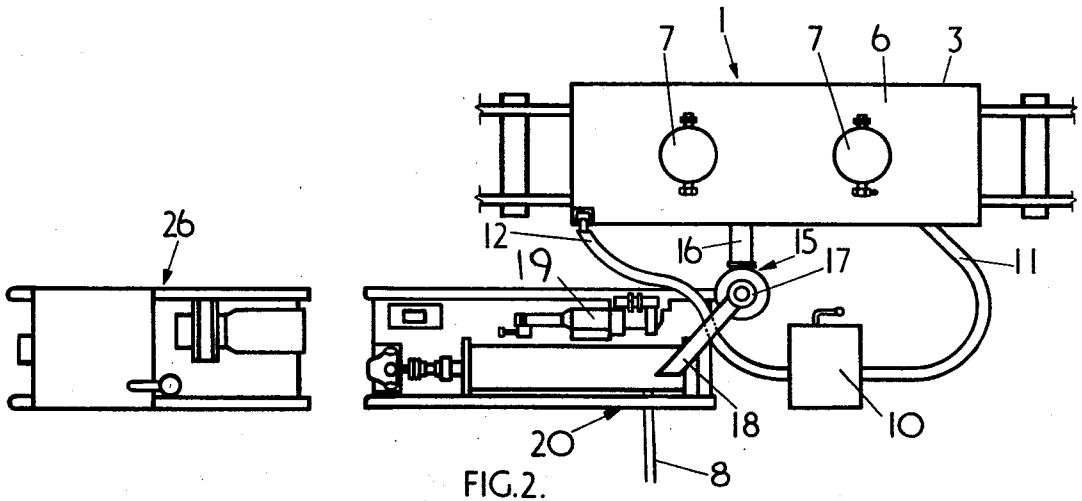
FIG. 2 is a plan of FIG. 1.

FIGS. 1 and 2 show a rail mounted mobile fluidised storage container 1 for powdered or particulate material, for example, cement, comprising a wheel mounted chassis 2 and a sealed bin compartment 3 having an inclined floor 4 and a similarly inclined perforated deck 5 arranged above the floor.

Preferably, the deck is of a permeable canvas type material. The compartment 3 is sealed from the atmosphere by a lid 6 having two filling doors 7 which when closed sealably engage the lid.

A blower unit 10 is arranged to deliver compressed air along hose 11 to the portion of the compartment 3 below the perforated deck 5 so that cement in the container 3 is fluidised by compressed air from the hose 11 which flows between the compartment floor and deck to pass through all the area of the deck. The cement becomes fluidised and flows relatively easily down the inclined deck towards a central discharge.

Spent fluidising air which has passed from the fluidised cement bed is extracted from a relatively upper portion of the sealed compartment through a hose 12 back to the blower unit 10, a filter being provided in the blower unit to prevent cement carried by the extracted air from passing into the compressor of the blower unit.

Cement passes through the central discharge into conveyor means 15 comprising a relatively lowermost compartment 16 for receiving cement falling from the central discharge, and a relatively uppermost compartment 17 for feeding cement along a downwardly inclined pipe 18 to a mixer unit 20. A vertical, driven screw conveyor is located in a central tubular compartment 21 of the conveyor means 15 for conveying material from the lowermost compartment to the uppermost compartment. The screw conveyor is driven by a hydraulic motor enabling the rotational speed of the screw conveyor to be adjusted to vary the amount of cement conveyed in a unit time. Thus, by calibrating the delivery of cement against the conveyor speed it is possible to determine and meter the amount of cement delivered to the mixer unit 20.

The mixer unit 20 comprises a mixing chamber including a mechanically driven paddle for mixing the cement with water fed to the mixing chamber by a hose 8. The mixer unit also comprises a hydraulically driven pump 19 arranged to urge the mixture of cement and water along pipe means (not shown) towards, for example, a strata control pack to be formed on an underground longwall face and adjacent to a roadway leading to the face.

A power pack 26 is provided to supply pressure fluid to drive the hydraulic motors on the blower unit, the conveyor means and the mixing and pump unit.

Figure 3:
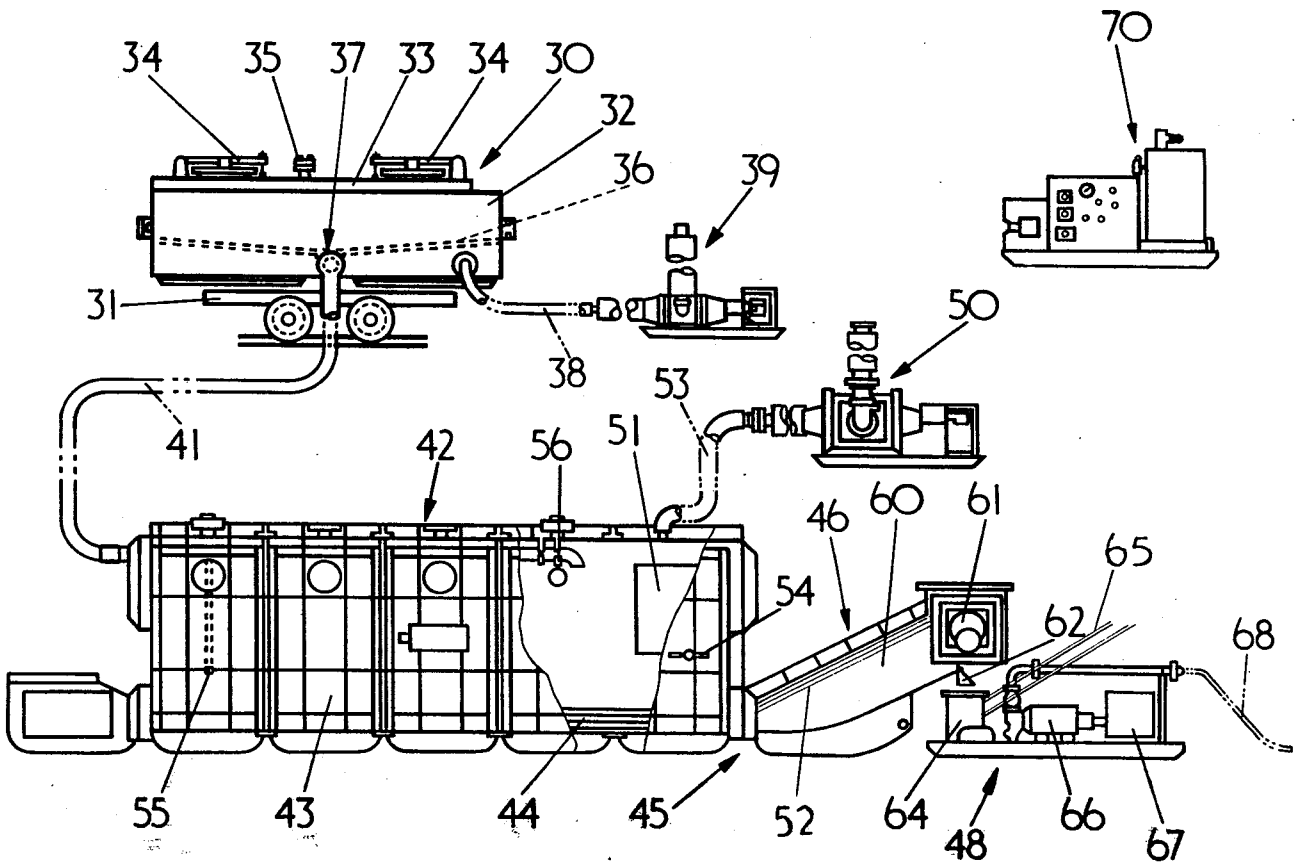
FIG. 3 is a diagrammatic layout of equipment for mixing cement and water to form a grout, the equipment being constructed in accordance with a second embodiment of the present invention.

FIG. 3 shows a second embodiment of equipment for mixing powdered or particulate material, for example, cement, with water to form a grout for forming strata control packs on a longwall face, the packs being formed adjacent to a roadway leading to the face.

The second embodiment of equipment comprises a rail mounted mobile fluidised storage container 30 including a wheeled chassis 31 and a bin compartment 32 having a lid 33 provided with refilling doors 34 and a air pressure sensitive control valve 35. The bin compartment includes an apertured deck 36 which is preferably of a permeable canvas type material and which is downwardly inclined towards a central discharge 37. The fluidised container 30 is fed with compressed air via a hose 38 from a driven blower unit 39, the compressed air flowing to all the area defined by the deck so that a fluidised bed of cement is formed over all the deck area.

Spent compressed air which has passed through the fluidised bed is used to activate a pneumatic conveyor arrangement which conveys fluidised cement from the central discharge 37 along a hose 41 towards a receiver unit 42 which comprises an assembled, sealed bin container 43 provided with a floor mounted scraper chain conveyor 44 (only a portion of which is shown) which extends along the full length of the bin container and which delivers cement into a relatively lowermost compartment 45 of conveyor means 46 for feeding cement from the receiver unit 42 to a mixing and pump unit 48.

The sealed bin container 43 constitutes an elutriator to the cement laiden air entering from the hose 41 and as the velocity of the air flow falls the cement settles out into the bin container. The air is drawn through the bin container 43 by an extractor unit 50, the air being drawn through a filter panel 51 and along a hose 53. The filter panel 51 includes a hand operated shaker device 54.

The receiver unit 42 includes two sensors 55 and 56 arranged to sense when the level of cement in the bin container 43 falls below a preselected lower level or rises to a preselected high level, respectively. Each sensor derives a signal to indicate when the cement level has reached the associated preselected level and a warning light siren or other indicator is activated on a control panel.

The cement discharged from conveyor 44 is conveyed from the lower compartment 45 of the conveyor means 46 by a hydraulically driven elevated scraper chain 52 housed within an housing 60 and driven by a variable speed hydraulic motor 61, the speed of the motor being calibrated against the amount of cement conveyed by the conveyor means 46 so that the amount of cement conveyed is metered at a preselected desired rate per unit time.

The elevated conveyor feeds the cement into a relatively high most compartment 62 which constitutes a hopper feeding cement to a mixing chamber 64 of the mixing and pumping unit 48. Water also is fed into the mixing chamber 64 at a desired preselected rate along a hose 65. Preferably, the mixing chamber is provided with a mechanically driven paddle (not shown).

The grout mixture of cement and water is fed at a desired constituency to a pump 66 which is driven by a hydraulic motor 67 to urge the grout along pipe means 68 in the direction indicated by arrow 'x,' the grout being fed, for example, to strata control packs (not shown) formed on a longwall face adjacent to a roadway leading to the face.

The pressure fluid to activate the hydraulic motors of the equipment is supplied from a powerpack 70 including pressure fluid supply lines (not shown).

In use, a train of fluidised storage containers filled with cement is delivered to the stationary receiver unit 42 and each is connected in turn to the bin container 43 by the hose 41 to be emptied rapidly by the fluidising action of air fed along hose 38 from the blower unit 39 and extracted via hose 41 by the extractor unit 50.

The stationary bin container has a substantial capacity sufficient to meet an incremental pack forming requirement. Also, a continuous discharge can be maintained from the bin container while the individual fluidised storage containers 30 are repeatedly connected and disconnected to the receiver unit to deliver their loads.

From the above description it will be appreciated that the two embodiments of equipment provide rapid and simple mixing and discharge of cement grout.

We claim:

1. Equipment for mixing powdered or particulate cement with a liquid, comprising a mobile fluidised storage container for the powdered or particulate cement, the fluidised storage container having a floor, an outlet and an air permeable deck arranged above the floor for supporting the powdered or particulate cement, a blower unit detachably connectable to the container for supplying fluidising air to the container in the space between the floor and deck, said compressed air passing through the deck to fluidise the powdered or particulate cement, a receiver unit independent of the container being selectively connectable to and disconnectable from the container for being supplied with and for accumulating cement from the container, a mixer unit for mixing the cement with liquid, conveyor means for feeding accumulated cement from the receiver unit to the mixer unit, liquid feed means for feeding liquid to the mixer, and pump means from the mixer unit for delivering a mixture of cement and liquid from the mixer unit to a point of use remote from said mixer unit whereby a succession of mobile fluidised storage containers can be connected to the receiver unit while said feeding of accumulated cement ensures a continuous flow of cement to the mixer unit.

2. Equipment as claimed in claim 1, in which the receiver unit has one or more sensors arranged to sense when the level of material in the receiver unit falls below or rises above a pre-selected level.

3. Equipment as claimed in claim 1, in which material is conveyed from the container to the receiver unit by a pneumatic conveyor which is at least partially activated by spent fluidising air.

4. Equipment as claimed in claim 1, in which the deck is formed of permeable canvas material.

5. Equipment as claimed in claim 1, in which the deck is downwardly inclined toward a central discharge port.

6. Equipment as claimed in claim 1, in which the receiver unit comprises a sealed bin container capable of receiving and storing material from the mobile storage container, provided with a floor mounted scraper chain conveyor which moves said material supplied from the fluidized storage container through the sealed bin container to the conveyor means.

7. Equipment as claimed in claim 1, in which the conveyor means comprises a relatively lowermost compartment for receiving material, a relatively uppermost compartment for feeding material to the mixer unit, and an elevating conveyor for conveying material from the lowermost compartment to the uppermost compartment.

8. Equipment as claimed in claim 7, in which the elevating conveyor comprises an elevating scraper chain.

9. Equipment as claimed in claim 7, in which the elevating conveyor is driven by a variable speed motor and means are provided for adjusting the speed of the motor to convey said powdered or particulate material at a preselected rate.

* * * * *